US006206748B1

(12) United States Patent
Kauth

(10) Patent No.: US 6,206,748 B1
(45) Date of Patent: Mar. 27, 2001

(54) SIMULATED WEAPON USING HOLOGRAPHIC IMAGES

(76) Inventor: Christopher Kauth, 268 Bush St. #3005, San Francisco, CA (US) 94104

( * ) Notice: Subject to any disclaimer, the term of this patent is extended or adjusted under 35 U.S.C. 154(b) by 0 days.

(21) Appl. No.: 09/072,378

(22) Filed: May 4, 1998

(51) Int. Cl.[7] ..... A63H 33/22; A63H 33/30; A63G 31/00; G03H 1/22

(52) U.S. Cl. ..... 446/219; 446/473; 446/485; 472/61; 359/33

(58) Field of Search ..... 446/219, 473, 446/485; 472/61, 72; 359/33

(56) References Cited

U.S. PATENT DOCUMENTS

| | | | | |
|---|---|---|---|---|
| 1,972,123 | * | 9/1934 | Zimmerman | 472/61 |
| 3,561,850 | * | 2/1971 | Shaffer | 472/61 X |
| 3,583,784 | * | 6/1971 | Hanna | 350/33 |
| 4,678,450 | * | 7/1987 | Scolari et al. | 446/473 |
| 5,145,446 | * | 9/1992 | Kuo | 446/473 X |
| 5,283,970 | | 2/1994 | Aigner . | |
| 5,885,129 | * | 3/1999 | Norris | 446/473 X |

FOREIGN PATENT DOCUMENTS

| | | | | |
|---|---|---|---|---|
| 2199253 | * | 6/1988 | (GB) | 446/473 |
| 1240425 | * | 6/1986 | (RU) | 446/473 |
| 1331525 | * | 8/1987 | (RU) | 446/473 |

* cited by examiner

*Primary Examiner*—D. Neal Muir

(57) ABSTRACT

A simulated weapon is disclosed which uses a hologram, an electric lamp and various other optical components to produce holographic images resembling the rays or beams of ray guns or space guns as portrayed in motion pictures, television programs, video games, and comic books in that the rays extend into and occupy space in front of the device itself but are not tangible. Sound effects accompany the projection of holographic images. The device also provides ancillary visual effects prior to the display of holographic images. Sound effects accompany the ancillary visual effects. The toy is intended for floor use and can be mounted on toy tank treads or other conveyance means. The rays are visible to those sitting, kneeling, or standing in front of the device. The preferred embodiment of the device is powered by an electric storage battery.

20 Claims, 5 Drawing Sheets

SIMULATED WEAPON USING HOLOGRAPHIC IMAGES

BACKGROUND

1. Field of the Invention

This invention relates to simulated weapons. The use of holographic images and accompanying sound effects allows the invention to replicate the overall effects associated with a variety of simulated weapons. The invention is particularly suited for use as a simulated weapon intended to resemble a laser-type gun, ray gun, or space gun weapon such as portrayed in motion pictures, television programs, and video games.

2. Description of Prior Art

Simulated weapons which employ visual effects, particularly those using vivid lighting, are well known. Devices which replicate conventional firearms have used flashing lights, often in conjunction with other effect to suggest muzzle flashes. Machine gun-type simulated weapons from the 1950s used flashing red lights together with a reciprocating plastic cylinder to imitate muzzle flashes. That visual effect involved both electric lighting and the extension into space of a physical object. Through its very rapid in-and-out motion, the plastic cylinder was intended to lose the appearance of a physical object.

Other simulated weapons have sought to rely on lighting effects alone to create the impression of muzzle flashes. For example, U.S. Pat. No. 5,283,970 to Aiger discloses a toy gun which relies entirely on a red light, which shows intermittently as the invention's barrel assembly rotates, to provide the impression of muzzle flashes.

While the previous examples have been of toys which resembled actual weapons (conventional firearms), space gun or ray gun-type simulated weapons do not, in general, resemble actual weapons. (Real laser beams are invisible under most circumstances, so such laser weapons as might exist are poor models for toys.) Nevertheless, the popular imagination clearly recognizes such weapons, and toy manufacturers have sought to produce simulated weapons which resemble them to supply the market. Early examples featured exotic body design and sometimes the use of electric lamps. Such devices did not, however, attempt to produce either real or imitative visible rays or beams. More recenly, Playmates carried a simulated weapon called Big Flash which does more to suggest the presence of a ray or beam during operation. A portion of the body of the toy consists of a plastic tube, shaped perhaps as a ray gun beam might be, which becomes lighted in conjunction with a sound effect when the device is operated. The effect achieved suggests the presence of a ray or beam extending into three dimensions. However, although the device emits light, the visible "beam" is part of the toy's body and does not extend beyond that body into space.

SUMMARY OF THE INVENTION

It is the object of the invention to provide simulated weapons for the amusement of children which are capable of producing rays or beams which more closely correspond to to those of ray guns or space guns as portrayed in motion pictures, television programs, and video games than has been commercially available heretofore.

Accordingly, several objects and advantages of the invention are that:

It produces images which appear to extend into and occupy space in front of the invention itself.

The images can be made to appear in a wide variety of forms; images of beams or rays resembling those of ray guns or space guns as protrayed in the popular media are possible.

These rays or beams have no physical form and are not part of the invention. No physical object is extended into space during the operation of the invention.

Because no mechanical operations are part of the invention's operating cycle, it has no moving parts to manipulate physical objects.

The absence of mechanical parts and the mechanical noises they produce means no interference with the sounds produced by accoustic devices capable of producing exotic sound effects. The illusion that the invention is an exotic weapon is enhanced. Further objects and advantages will become apparent from the drawings and description.

The preferred embodiment of the invention is a special effects device intended to function as a simulated weapon. The invention employs an arrangement of optical components for the purpose of producing holographic images and acoustical components to produce sound effects. In addition, the invention has externally mounted electric lamps for producing ancillary visual effects.

In operation the invention is activated when a control unit is itself activated and a sequence of electrical circuits are completed such that ancillary visual effects occur in concert with sound effects and such that after the ancillary visual effects have completed their operation the beams or rays produced by a hologram are activated in concert with sound effects.

DESCRIPTION OF THE INVENTION

Figure 1:
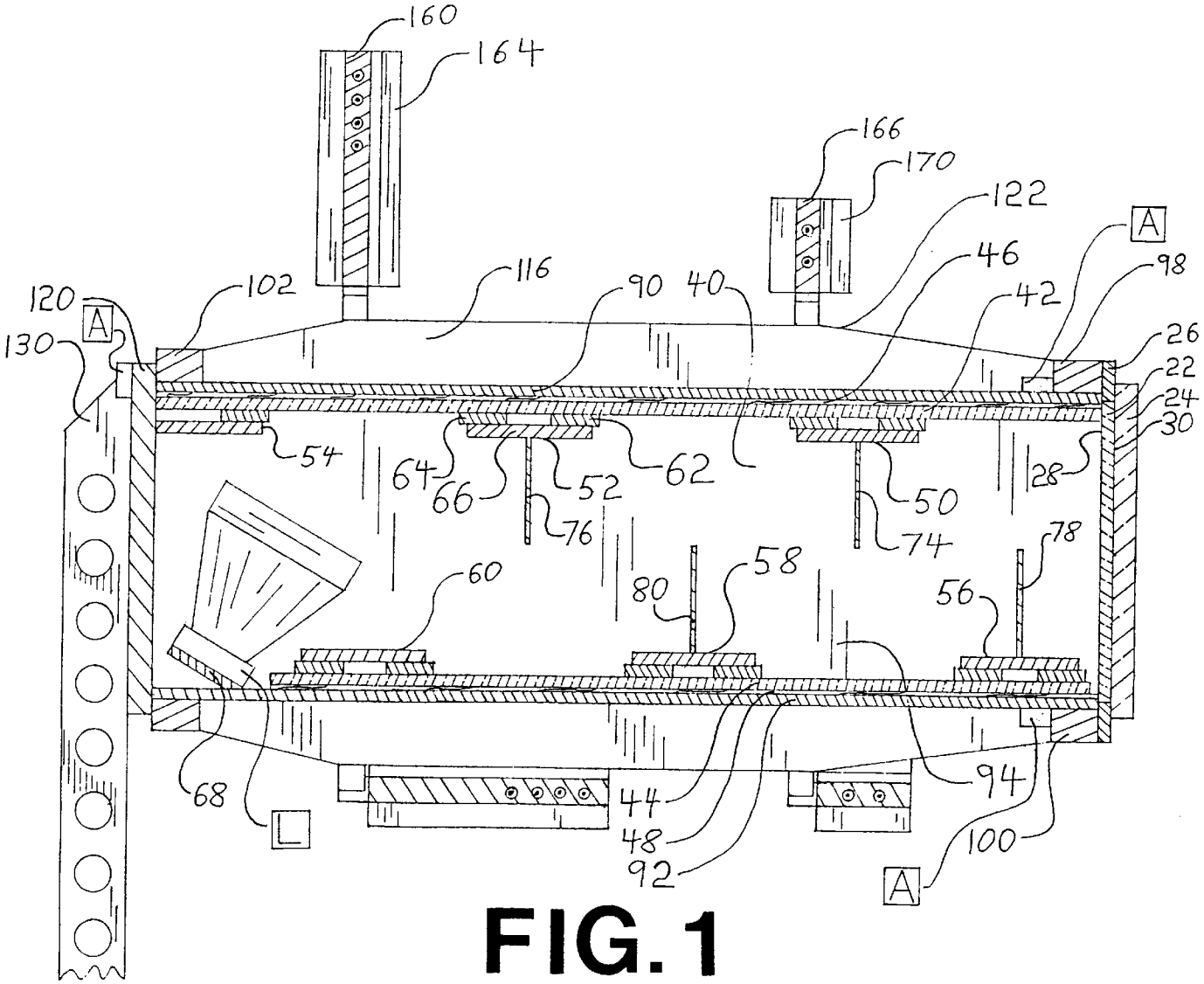
FIG. 1 is a sectional view of the invention. The lamp, several acoustic devices, and a portion of the support assembly are shown in side elevation.
Figure 2:
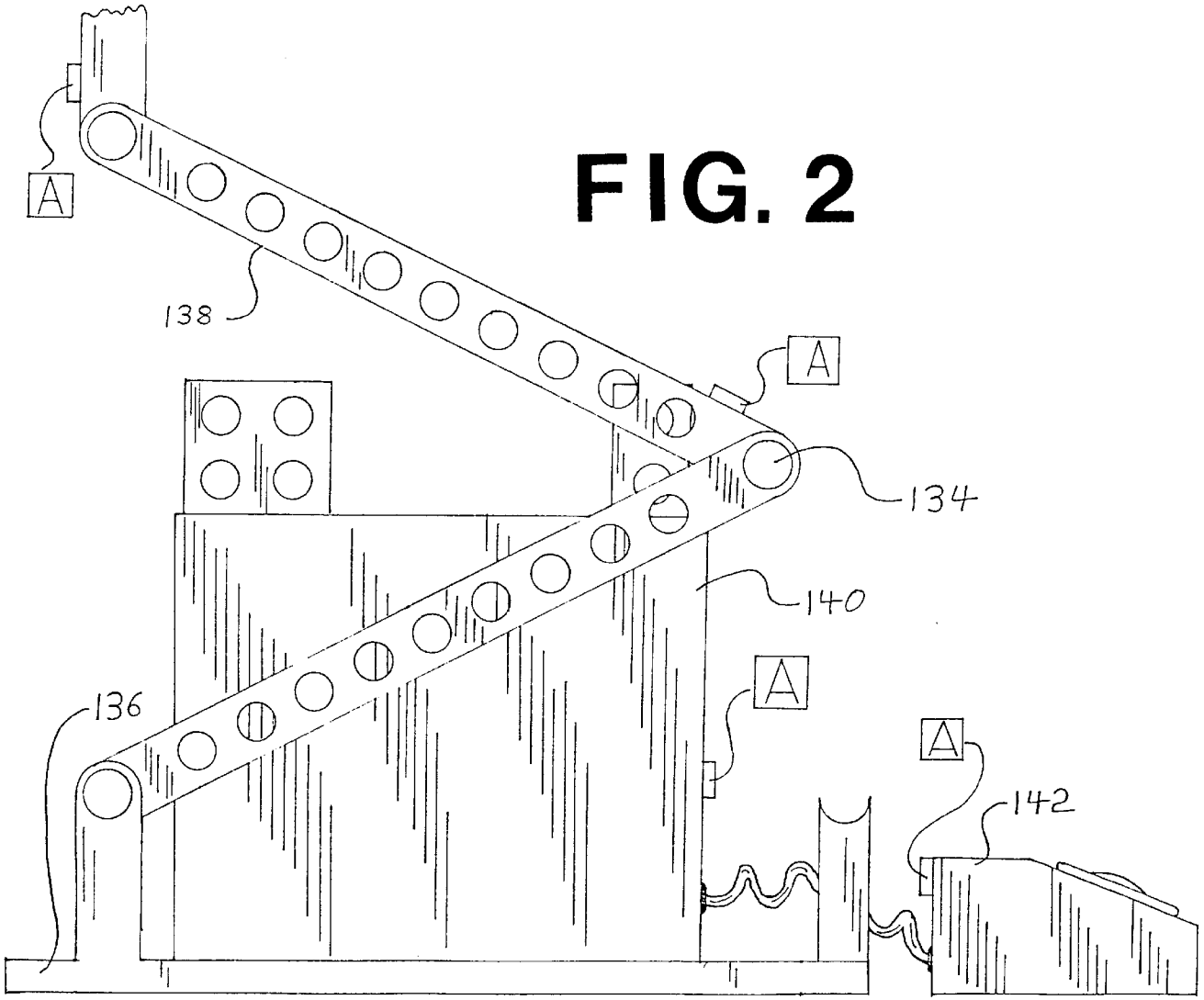
FIG. 2 is a side elevation of the support structure assembly, the power supply unit, and the control unit. A part of the support structure assembly is not shown.

Referring to FIG. 1 and FIG. 2 it can be seen that structurally the invention consists of a body structure assembly 122 and a support structure assembly 138. Support structure assembly 138 supports body structure assembly 122 and controls the orientation of body structure assembly 122. Body structure assembly 122 positions most of the functional components of the invention and encloses many of those components.

A hologram 22 is held against longitudinal movement by a color filter 24 and the forward edges of body structure assembly 122. Hologram 22 is secured against transverse movement by a sash 26. Both color filter 24 and sash 26 are fastened to body structure assembly 122.

Hologram 22 at the margins of a first surface 28 impinges on the forward edges of body structure assembly 122. The remainder of the first surface 28 is adjacent to an interior chamber 40. Color filter 24 impinges on the entirety of a second surface 30 of hologram 22.

Interior chamber 40 is defined by a side panel 94 and a side panel 96 (not visible in FIG. 1, but shown on its external side in FIG. 5) and by an upper mirror 42 and by a lower mirror 44 and by a bottom panel 92 and a back panel 120.

Upper mirror 42 is adjacent to and impinges upon an upper cushioning pad 46 and lower mirror 44 is adjacent to and impinges upon a lower cushioning pad 48.

Upper cushioning pad 46 is adjacent to and impinges upon a top panel 90 and lower cushioning pad 48 is adjacent to and impinges upon bottom panel 92.

Upper mirror 42 is held in position by mirror support assemblies 50 and 52, and partial mirror support assembly 54.

Lower mirror 44 is held in position by mirror support assemblies 56 and 58 and 60.

Mirror support assembly 52 consists of mirror impingment members 62 and 64, and also central member 66. Mirror impingement members 62 and 64 are adjacent to and impinge upon mirror 42. Central member 66 is fastened to mirror impingement members 62 and 64, and is also fastened to side panels 94 and 96, thereby holding mirror support assembly 52 in position.

Mirror support assemblies 50, 56, 58, and 60 are identical in structure to mirror support assembly 52.

Partial mirror support assembly 54 has only one mirror impingement member, but is otherwise identical to mirror support assembly 52.

A lamp L (indicated with a letter L inside a rectangle) is disposed in interior chamber 40. Lamp L is mounted on mounting panel 68, which is fastened to side panels 94 and 96. As shown in FIG. 1 mounting panel 68 is rotated relative to the plane of bottom panel 92 by a predetermined angle. The orientation of lamp L is accordingly determined by the rotation of mounting panel 68.

Figure 4:
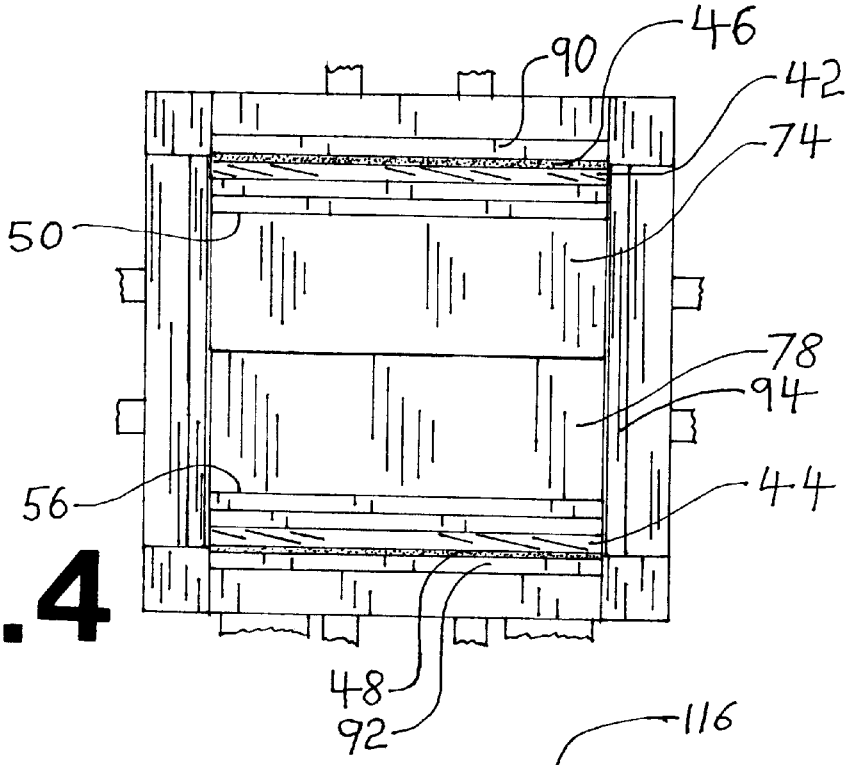
FIG. 4 is a partial front elevation of the invention with the color filter, the hologram, and the sash removed. The front of the body structure assembly is shown, as is some of the interior chamber. Portions of the longitudinal fins are shown. The most forward two light baffles can be seen inside the interior chamber, blocking any view further into that chamber.
Figure 3:
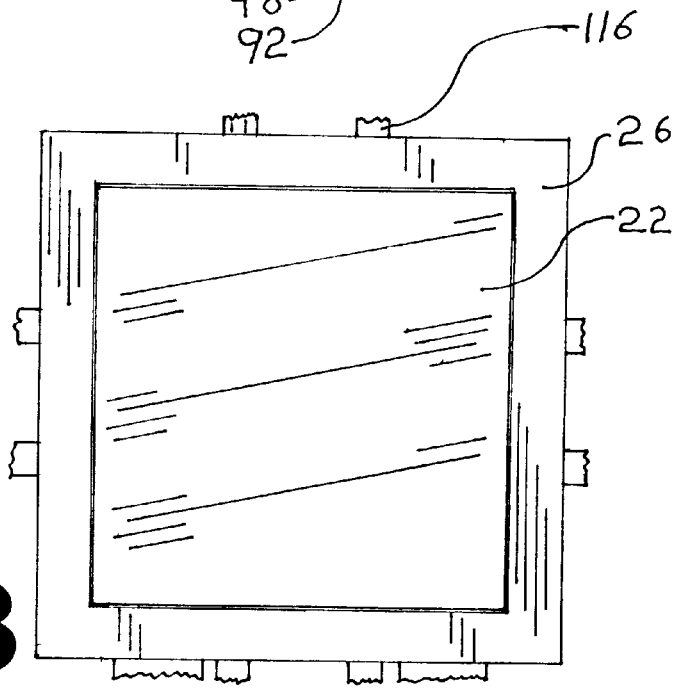
FIG. 3 is a partial front elevation of the invention with the color filter removed showing the hologram and the sash which surrounds it. Except for portions of the longitudinal fins the body structure assembly is entirely out of view.

Light baffles 74, 76, 78, and 80 are attached to mirror support assemblies 50, 52, 56, and 58 respectively. FIG. 4 shows light baffles 74 and 78 from the front.

Figure 5:
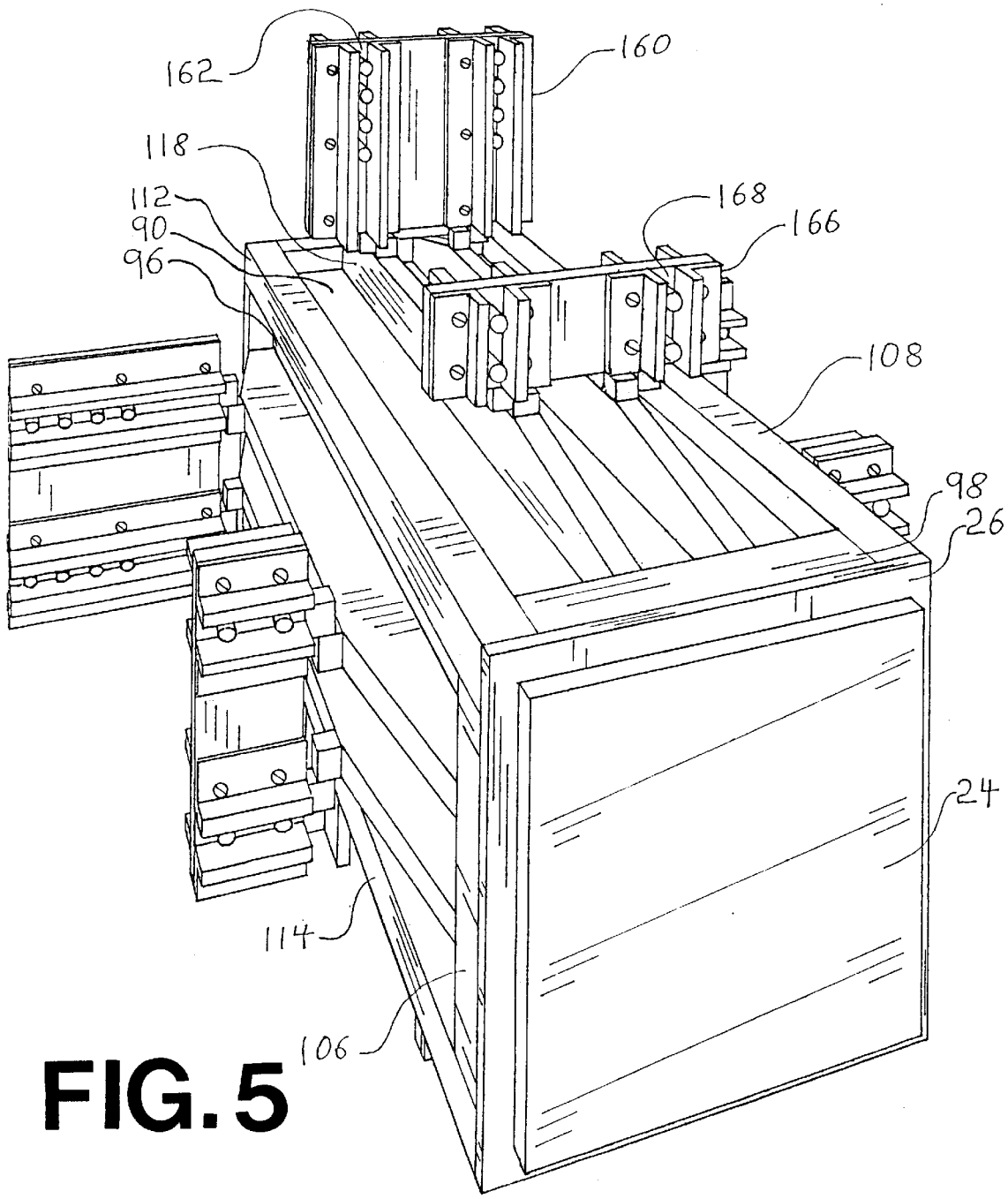
FIG. 5 is a perspective view of the invention. The support structure assembly, power supply unit, and control unit are not shown. The large and small electrified panels are shown perpendicular to the sides of the invention. The drawing is four thirds the scale of FIGS. 1 through 4.

Top panel 90, bottom panel 92, and side panels 94 and 96 are connected to and joined together by four corner members. FIG. 5 provides an external view of this arrangement showing top panel 90 with corner members 108 and 112 fastened to each side, and side panel 96 with corner members 112 and 114 fastened to each side.

Four cross members are disposed at each end of the four corner members and are fastened to the corner members. This arrangement can be seen in FIG. 5: cross member 98 is disposed between corner members 108 and 112, and cross member 106 is disposed between corner members 112 and 114.

A longitudinal fin 116 is disposed on top panel 90 and is fastened to cross members 98 and 102. A longitudinal fin 118 (not shown in FIG. 1 but is shown in FIG. 5) is parallel to to longitudinal fin 116 and is also disposed on top panel 90 and is fastened to cross members 98 and 102. Bottom panel 92, and side panels 94 and 96 each have a similar pair of longitudinal fins disposed on them. Such longitudinal fins are fastened to the cross members upon which they abut.

A back panel 120 is fastened to cross member 102 and the other three aft cross members.

The two side panels, the top panel, the bottom panel, the four corner members, the eight cross members, the eight longitudinal fins, and the back panel as assembled compose the body structure assembly of the invention.

While the preferred embodiment employs a body structure composed of many individual components, it will be appreciated that many alternative embodiments exist which use the functional equivalent of the body structure assembly of the preferred embodiment. In particular, contemporary toy manufacturing practice would indicate that a molded plastic body structure consisting of two components be employed in place of the arrangement of the preferred embodiment. In addition, while the preferred embodiment employs fasteners to secure various components to the body structure assembly, other means of attachment are also useable and should be considered the functional equivalent of fastener means. Also in addition, it should be noted that alternative impingement schemes may be employed to secure components such as the mirrors, the hologram, the color filter, the lamp, and the light baffles. Such arrangements are facilitated by the use of molded plastic, as fitted grooves or rabbets can be prepared into which the various components can be inserted. With appropriate grooves or rabbets on a second body component, that second body component can be simultaneously fitted on both the partially secured components and the first body component. Such an impingement arrangement should be considered an alternative embodiment of the invention.

Support structure assembly 138 is fastened to body structure assembly 122 at back panel 120.

Support structure assembly 138 is composed of a rigid beam 130 and a second rigid beam (not shown), folding legs 134, and a base 136. Those components are linked by pivot means as shown in FIG. 2.

A power supply unit 140 is mounted on base 136 by attachment means.

A control unit 142 is freestanding.

Acoustic devices A (indicated with an A inside a rectangle) are disposed about the invention and are attached to it.

A large electrified panel 160 positions columns of lamps 162. There are two such columns on large electrified panel 160. Each column consists of four individual lamps. Large protective fins 164 are disposed on each side of both columns of lamps. Back fins 172 are disposed on the aft surface of large electrified panel 160.

Large electrified panel 160 is mounted on longitudinal fins 116 and 118 by hinge means. By use of such hinge means large electrified panel 160 can be positioned so that it is perpendicular to top panel 90 or it can be positioned so that it is parallel to top panel 90.

Figure 6:
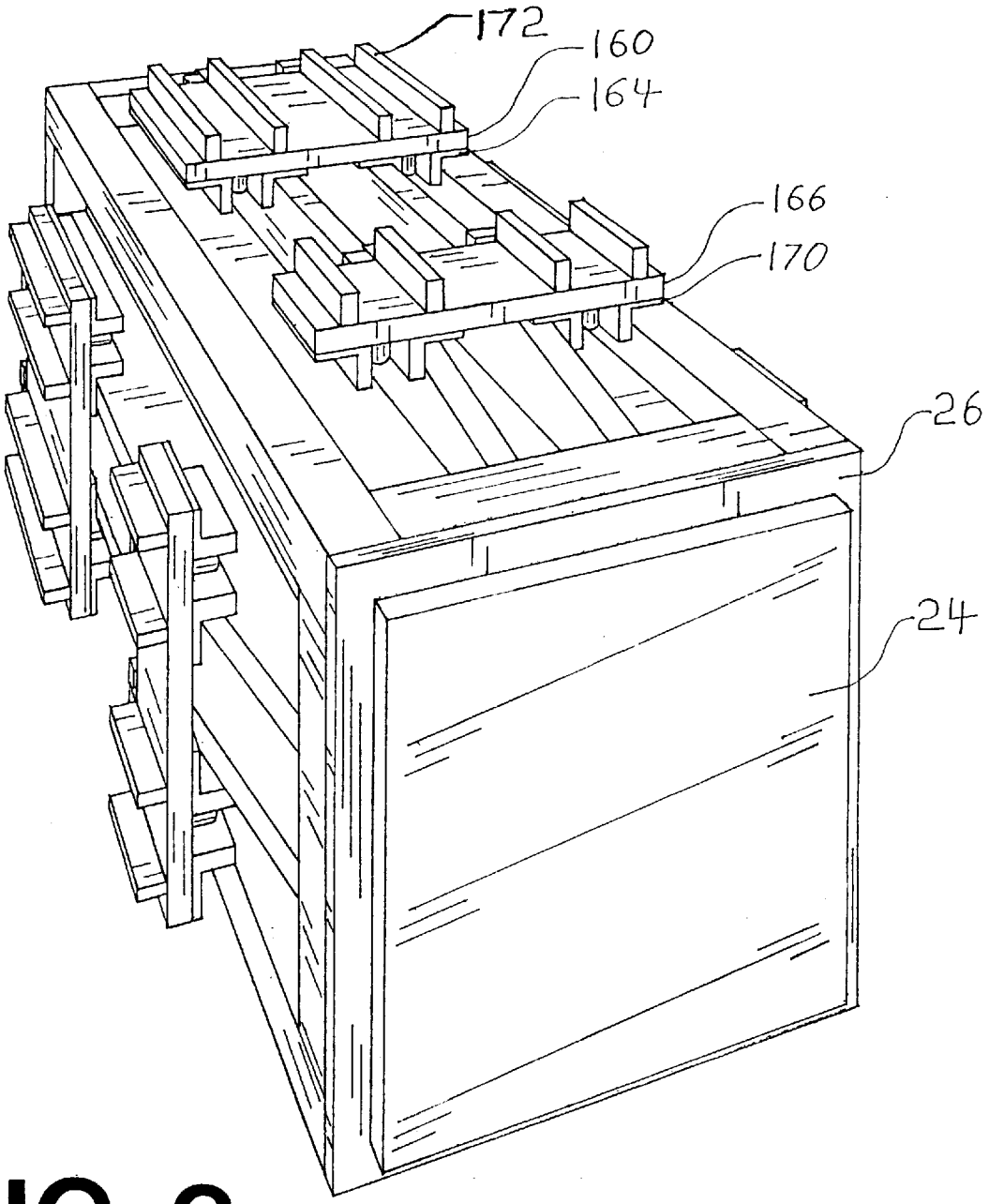
FIG. 6 is a perspective view of the invention. The support structure assembly, power supply unit, and control unit are not shown. The large and small electrified panels are shown parallel to the sides of the invention. The drawing is four thirds the scale of FIGS. 1 through 4.

The alternative positions of large electrified panel 160 can be seen in FIG. 5 and FIG. 6.

Three other such large electrified panels are disposed similarly on the other three sides of body structure assembly 122.

A small electrified panel 166 positions two columns of lamps 168. Each column consists of two individual lamps.

Small protective fins 170 are disposed on each side of each column of lamps.

Small electrified panel 166 is mounted on longitudinal fins 116 and 118 by hinge means. By use of such hinge means small electrified panel 166 can be positioned so that it is perpendicular to top panel 90 or it can be positioned so that it is parallel to top panel 90.

Three other small electrified panels are disposed similarly on the other three sides of body structure assembly 122.

Theory of the Invention

The invention exploits the ability of holograms to project images having three dimensions exhibiting either full, partial, or reversed parallax. In order for images to be projected holograms must be lighted. Depending on the type of hologram employed the method of lighting which produces the best results will vary. The preferred embodiment of the invention uses a transmission hologram to produce visible images; light is directed onto the side of the hologram opposite to the side intended for viewing. Ordinarily, although not always, the light rays directed onto the hologram must be incident upon the hologram at a specific and predetermined angle in order to obtain satisfactory results. In principle, that angle could be ninety degrees, that is, an arrangement where the light rays incident upon the hologram are perpendicular to it. Although a hologram produced so as to have light directed onto it at that angle would produce images, those images would be seen with and be diminished by whatever light source produced the light rays incident upon the hologram. Accordingly, because the light source can be positioned out of view, holograms prepared so that they can be lighted by light rays incident at less than ninety provide better results. A suitably prepared hologram is not enough, however, a lighting system or arrangement must also be provided. Bright, vivid images require that the light source not compete with the images projected by the hologram; the light source must not be visible when viewing the hologram.

The lighting system or arrangement, in order to make discernable images possible, must be designed with consideration given not only to the characteristics of the hologram, but also how the hologram will be viewed and how the images produced fit in with the overall purposes of the invention. The invention is a simulated weapon to be used as a toy. Accordingly, the body of the the toy must resemble a weapon or what the popular imagination says a weapon of its type should look like. The images produced, which are to resemble the rays or beams of ray or space guns, must emerge from the front of the invention in a manner consistent with notions about what the operation of such a weapon entails. If the assumption is that the rays or beams are to resemble either actual laser beams or what laser beams are imagined to look like, then either a beam or a pattern of beams must be seen as having emerged from the front of the invention in a direction consistent with a straightline extension of the body of the invention itself. Projected images composed of more exotic configurations are also consistent with the purposes of the invention, but there remains a strong presumption in favor of regular geometric shapes and symmetry; the projected images should center about the axis of the invention.

The center of such projected images is seen by looking along a ray perpendiclar to the surface of the hologram and whose origin is at the center of the hologram. The axis of the invention runs parallel to the length of the invention, and more exactly, parallel to both side panels and the top and bottom panels and is equidistant between the side panels and is equidistant between the top and bottom panels. The hologram and the images it projects are positioned correctly when the center-of-image ray is included in the axis of the invention; the body of the invention is perpendicular to the plane of the hologram. The lighting system or arrangement then is largely confined to the space behind the hologram as too much bulk extending beyond that region of space will tend to diminish the weapon-like appearance of the invention. Since direct lighting of the hologram reduces the visibility of the projected images, a means must be found to employ a lamp in the space behind the hologram without having it light the hologram directly. Because direct lighting is precluded an access channel for light rays to reach the surface of the hologram must also be provided. The invention employs an arrangement of light baffles positioned between the lamp and the hologram so no direct access to the hologram by light rays emitted by the lamp is possible. In addition, the light baffles define channels which allow light rays emitted by the lamp to reach the hologram by sequential reflection off the two mirrors. The channel formed by the mirrors and the light baffles not only provides a means of reaching the hologram for light rays emitted by the lamp, but also controls the angle at which the light rays are are incident upon the hologram. That angle must be and is predetermined both for the lighting arrangement and the hologram. The particular angle selected can be the result of many considerations pertaining to both holography and the design of the simulated weapon in other respects. The sharply defined channel formed by the light baffles and mirrors also tends to eliminate stray light rays so that all light rays striking the hologram are substantially parallel. Typically, in order to obtain good holographic images, it is necessary not only to control the angle at which the light rays are incident upon the hologram, but it is necessary also to assure that the incident light rays are substantially parallel. While holograms can be produced which require alternative lighting arrangements, such as a different angle of incidence for every point on the hologram's surface, in general, to facilitate flexibility in subsequent use holograms are made so that they are properly lighted with substantially parallel light rays. Accordingly, there is an advantage in having sustantially parallel light rays incident upon the hologram. A longer light channel tends to assure that result, particularly if the lamp does not include a parabolic reflector or the beam which emerges from the parabolic reflector is not composed of substantially parallel light rays. The zigzag pattern of the light channel provides a longer run than would a direct line arrangement, and so further improves the quality of the holographic images projected.

An alternative embodiment of the invention trades the projected-images-in-line-with-the-body-of-the-invention feature for a vastly simpler lighting system or arrangement which does employ direct lighting of the hologram without a loss of image quality. The hologram is rotated with respect to the body of the invention so that the center-of-image ray is not included in the axis of the invention, but instead is at a predetermined angle to it. The hologram and the projected images produced by the hologram can be viewed without seeing anything inside the body of the invention with such an arrangement. The lamp can be positioned inside the body of the invention and have a direct channel to the hologram for lighting purposes; the lamp will not be seen when viewing the hologram along its center-of-image ray.

The Color Filter

A transmission hologram breaks white light into the colors of the spectrum. When lighted by a source of white light any image recorded in the hologram will appear in multiple versions corresponding to the colors recognized by human vision. (Except when a rainbow type hologram is used and a single image composed of the colors of the spectrum results.) Having multiple images in different colors is not necessarily at odds with the purpose of the invention and an alternative embodiment of the invention makes use of a multiple color, multiple image effect. Nevertheless, a better result is obtained particularly insofar as radial symmetry is desired in the images projected when a single image, however blurred, is projected. To obtain that effect a color filter is employed in the invention to suppress substantially all light rays outside of a narrow bandwidth. That filter can be positioned anywhere in the invention so long as the images projected are substantially monochromatic. The preferred embodiment uses a transparent plastic panel of the appropriate color in front of the hologram as the color filter, but a similar component positioned anywhere across the light channel between the lamp and the hologram would also serve to ensure that the projected images are substantially monochromatic and therefore single images with some blurring instead of multiple images.

Description of the Invention - Operation

The components disposed in interior chamber 40: lamp L, upper mirror 42, lower mirror 44, and light baffles 74, 76, 78, and 80 are arranged so as to direct light rays onto hologram 22 at a predetermined angle. For the purposes of describing and claiming the invention that angle is defined as the reference angle, a term which drives from the procedure typically used to prepare holograms. (Neither holographers nor the literature use this definition of reference angle consistently. Nor is any other term consistently used to denote this angle.) The reference angle is measured from the first surface 28 of hologram 22 in angular distance from the vertical. The orientation of Lamp L can similarly be described in terms of angular distance from the vertical. The orientation or angle from the vertical of Lamp L is set equal to the reference angle of hologram 22. Light rays emitted by Lamp L strike upper mirror 42 at an angle known as the angle of incidence, measured from the surface of the mirror. By geometric law the angle of incidence equals ninety degrees minus the angle of Lamp L's orientation. Because the orientation of Lamp L is set equal to the reference angle of hologram 22 it follows that the angle of incidence of light rays striking upper mirror 42 is equal to ninety degrees minus the reference angle of hologram 22. FIG. 1 shows that by sequential reflection light rays which initially strike upper mirror 42 between partial mirror support assembly 54 and mirror support assembly 52 eventually strike upper mirror 42 between mirror support assembly 50 and the first surface 28 of hologram 22. They do so at the same angle of incidence: ninety degrees minus the reference angle. By the laws of Optics the angle of reflection is equal to the angle of incidence. Accordingly, the light rays are reflected from upper mirror 42 at an angle of reflection equal to ninety degrees minus the reference angle of hologram 22. Those light rays are then necessarily incident upon the first surface 28 of hologram 22 at the reference angle of the hologram.

Light baffles 76, 80, 74, and 78 block stray light rays emitted by lamp L from reaching hologram 22 directly. In addition, those light rays not substantially parallel to the preponderance of light rays emitted by lamp L tend to strike light baffles 76, 80, 74, and 78, or side panels 94 and 96. As a result those light incident upon the first surface 28 of hologram 22 are substantially parallel. As explained, having substantially parallel light rays incident upon the hologram improves the quality of the holographic images produced.

The preferred embodiment of the invention employs a pair of parallel mirrors to direct light rays onto the first surface 28 of hologram 22 at the reference angle. Other configurations of mirrors and light baffles exist which can also correctly direct light rays onto the hologram and should be considered alternative embodiments of the invention. In addition, the reference angle of the invention is itself arbitrary and, constrained only by concerns explained in the theory of the invention section, can be selected so as to accommodate alternative arrangements of mirrors and light baffles. Any simulated weapon which employs a hologram having any reference angle is an alternative embodiment of the invention.

Hologram 22 is a projection hologram. That name recognizes the high verisimilitude achieved by such holograms in re-creating images of three dimensional objects in the space forward of the holograms themselves. Projection holograms are characterized by producing or projecting real images which exhibit full parallax and also by the particular procedure typically used to make them. The term projects for the purposes of describing and claiming the invention means creating an image which appears to extend into and occupy space in front of the device creating that image. It must be noted that the procedure used to prepare or make such holograms can arbitrarily place the apparent position of projected images with respect to the surface of the hologram itself. That is, the image produced by the completed hologram can appear to be behind the surface of the hologram or it can appear to straddle the hologram, with the image extending into space both fore and aft of the hologram. Because of that possibility or capability the term projects is further defined to mean for the purposes of describing and claiming the invention creating an image which appears to extend into and occupy space both fore and aft of the hologram. Holograms having that capability are defined for the purpose of describing the invention as projection holograms if and only if the image which appears to be in front of the hologram exhibits full parallax. It must be acknowledged that the above expanded definition of projection hologram is not used by all holographers. The term projects, as both narrowly and broadly defined for the purposes of describing and claiming the invention is not restricted to producing images which exhibit full parallax. A holographic image which appears to extend into and occupy space both fore and aft of the hologram but does not exhibit full parallax or appears to extend into and occupy space only in front of the hologram and does not exhibit full parallax is an image which a hologram projects as that term is used here. Hologram 22 is a projection hologram as broadly defined here.

Alternative types of holograms can also be employed in the invention. Although holographic images which exhibit full parallax are most effective, full parallax is closely approximated under most circumstances by holograms which project images exhibiting partial parallax (left-to-right but not above-to-below, for example). Holograms which project images exhibiting partial parallax are the functional equivalent of those which project images exhibiting full parallax. A device which uses a hologram which projects images exhibiting partial parallax but which is otherwise identical to the preferred embodiment of the invention is an alternative embodiment of the invention. A device which uses a hologram which projects images exhibiting partial parallax but which is otherwise identical to an alternative embodiment of the invention is itself an alternative embodiment of the invention.

Holograms which project images exhibiting reversed parallax can be employed in the invention. Devices which use holograms which project images exhibiting reversed parallax but which are otherwise identical to the preferred embodiment of the invention are alternative embodiments of the invention. Devices which use holograms which project images exhibiting reversed parallax but which are otherwise identical to an alternative embodiment of the invention are themselves alternative embodiments of the invention.

Holograms which have the characteristic of being able to project images, whether those images exhibit full, partial, or reversed parallax, and which have been made using alternative techniques should be classified on the basis of those external characteristics and not on the basis of how they were made. Accordingly, computer generated holograms which can project images must be regarded as the functional equivalent of those made by conventional means. Devices using such holograms which are otherwise identical to the preferred embodiment of the invention, or to an alternative embodiment of the invention are themselves alternative embodiments of the invention.

An original projection hologram appropriately prepared can be mass produced using embossing technology. The embossed holograms which are produced as copies are also projection holograms.

Hologram 22 is lighted on the side opposite the side intended for viewing. Because of that charateristic hologram 22 is properly referred to as a transmission hologram. Being a transmission hologram does not contradict hologram 22's being a projection hologram.

When lighted by substantially parallel light rays of white light incident upon first surface 28 at its reference angle hologram 22 produces multiple images, each a version of the image hologram 22 is intended to project. Each image corresponds to a color recognized by human vision. The spectrum of multiple images is ordered vertically with magenta at one extreme and purple at the other. All such projected images are formed by light rays emitted by second surface 30 of hologram 22. Color filter 24, which is adjacent to hologram 22, suppresses substantially all such light rays outside of a narrow bandwidth corresponding to the color red. Color filter 24, which consists of transparent red plastic, also acts as a cover plate for the protection of hologram 22, and as a structural component locking hologram 22 in position. The effect of color filter 24 on the range of images produced by hologram 22 is to render most of them indiscernable; a red image can be seen.

Although the color filter used by the prefered embodiment is red, there is no requirement that a red color filter be used. (Certain aspects of making original holograms are facilitated when the color filter to be employed matches the color of the laser light used in making the original hologram.) If a color filter other than red is used in the invention the projected image will not only appear in that diferent color, but also have its position shifted as compared to the red image. Accordingly, if the image produced is to retain the original form. a somewhat different hologram will have to be used.

The use of a color filter other than red in a device otherwise identical to the prefered embodiment or an alternative embodiment of the invention except that the hologram has been prepared to compensate for the use of a differently colored color filter is also an alternative embodiment of the invention.

The use of a color filter other than red in a device otherwise identical to the preferred embodiment of the invention or an alternative embodiment of the invention is also an alternative embodiment of the invention.

The image projected by hologram 22 and reduced to a single color and form by color filter 24 appears to be four segmented columns arranged in a two-by-two pattern which spread out, away from each other, as their distance from the surface of color filter 24 increases. The columns appear to begin in the interior of the invention and extend forward into space. The individual segments are glowing red, everything else in the image is black. The effect created is as though several pulses of rays or beams from the invention had been fired. This holographic image is described to further disclose how hologram 22 and color filter 24 operate and should not be regarded as limiting the appearance of holographic images projected by the invention.

The system for producing holographic images described which includes those components disposed within interior chamber 40: lamp L, mirror support assemblies 50, 52, 56, 58, and 60 and partial mirror support assembly 54, and light baffles 74, 76, 78, and 80; and also upper mirror 42, lower mirror mirror 44, hologram 22, and color filter 24; together with structural components upper cushioning pad 46, lower cushioning pad 48, sash 26, support structure assembly 138, and body structure assembly 122, and mounting panel 68; and also functional components: accoustic devices A, power supply unit 140, and control unit 142, are as assembled an alternative embodiment of the invention. Holographic images can replicate most visual effects associated with simulated weapons of the prior art and the external appearance of the body structure assembly can take many forms corresponding to examples from the prior art. Accordingly, the holographic image projecting ability of this alternative embodiment, along with appropriate accoustic devices permits it to function as a simulated weapon in a wide variety of forms.

Large electrified panel 160 and the three identical large electrified panels similarly disposed on the other three sides of body structure assembly 122 and small electrified panel 166 and the three identical small electrified panels similarly disposed on the other three sides of body structure assembly 122 permit the positioning of external lamps. The arrangement of the lamps of the preferred embodiment allows some of the external lamps on the large electrified panels to be seen without interference from the small electrified panels when the invention is viewed from along its longitudinal axis at a distance from the invention expected to be convenient for a user of the invention. The external lamps are lighted in a sequence: the lamps on the large electrified panels are lighted first for a predetermined period of time and then the lamps on the small electrified panels are lighted for a predetermined period of time. The next step in the sequence is the projection of the holographic image, also for a predetermined period of time. The entire cycle is completed in less than ten seconds. Because the positioning of the external lamps is generally concentric about the longitudinal axis of the invention, their lighting sequence is intended to suggest the convergence of energy on color filter 24 immediately prior to the projection of the holographic image. This overall visual effect contributes to the illusion that an exotic weapon is being operated.

A device which is otherwise identical to the preferred embodiment or an alternative embodiment of the invention but is characterized by a different operating sequence or by the operating sequence of the preferred embodiment where the duration of the operating cycle is ten or more seconds is also an alternative embodiment of the invention.

The preferred embodiment employs direct current electrical components. Wiring is run through prepared channels.

An alternative embodiment of the invention uses wall current. The power supply system employs a transformer and an AC-to-DC converter or rectifier.

The invention is activated when control unit 142 is switched to the on position. That action completes the first of three principal electrical circuits in the invention. The first principal electrical circuit provides electric power to large electrified panel 160 and the other three large electrified panels, it also provides electric power to acoustic devices A. After a predetermined period of time control unit 142 breaks the first principal circuit and completes the second principal electrical circuit. That circuit provides electric power to small electrical panel 166 and the other three small electrified panels, it also provides electric power to acoustic devices A. After a predetermined period of time control unit 142 breaks the second principal circuit and completes the third principal electric circuit. The third principal circuit provides electric power to lamp L, it also provides electric power to acoustic devices A. After a predetermined period of time control unit 142 breaks the third principal circuit and he device becomes inactive.

An alternative embodiment of the invention links different acoustic devices with each principal circuit. In that way each step in the operational sequence is accompanied by different sound effects.

It can be seen that the invention, through the use of holographic images, is able to achieve what no simulated weapon heretofore has been able to: project rays or beams which extend into and occupy space in front of the invention itself. The invention exploits the optical properties of holograms to do this. In projecting a pattern of visible rays or beams, the invention does what no real weapon can do. Real laser beams are invisible unless they pass through smoke or fog. Only in the media do ray guns emit rays emit rays which can be seen. But, due to the impact such portrayals have had on the popular imagination, it is widely assumed that such weapons could exist. Accordingly, there is a market for any toy which appears to project real rays or beams as does the invention. The invention enhances this effect through the impression of converging energy created by the electrified panels operating in sequence. Sound effects unhindered by mechanical noises complete the illusion that an exotic weapon is being operated.

While the above description contains many specificities these should not be construed as limitations on the scope of the invention, but rather as an exemplification of the preferred embodiment. Many other variations are possible. An exhaustive listing of alternative embodiments is impossible. It is possible, however, to list the most obvious alternative embodiments. They include:

A) versions of the invention which eliminate elements employed in the preferred embodiment or add elements to those employed in the preferred embodiment or both.

B) versions of the invention employing elements which are different from those employed in the preferred embodiment but which are the functional equivalent of those elements.

C) versions of the invention which are substantially the same as the either the preferred embodiment or one of the alternative embodiments except that they can be described differently by including components having names recognized and established in commerce, but which do not correspond to those names or terms used in the description of the preferred embodiment or the alternative embodiments as described below.

D) versions of the invention which are obvious combinations of any of the alternative embodiments in the above catagories or the preferred embodiment itself.

Accordingly, the obvious alternative embodiments are the preferred as described with the indicated modification:

1.) Eliminate the color filter so that the projected image produced by the hologram is visible in every color of the spectrum.

2.) Eliminate the color filter and use a rainbow-type hologram so that the projected image produced by the hologram is single image composed of striations representing every color of the spectrum, but exhibiting only partial parallax.

3.) Eliminate the color filter and use what is known commercially as a substantially monochromatic source of light in place of the lamp. Note that such devices are not true monochromatic-in-origin light sources, but include color filtering means.

4.) Eliminate the color filter and use a lamp containing a color filter anywhere in its structure.

5.) Eliminate the color filter and use light emitting diodes of the appropriate color. Note that light emitting diodes are not true monochromatic-in-origin light sources.

6.) Eliminate the color filter and use second surface mirrors composed of appropriately colored material.

7.) Eliminate the color filter and use at least one prism to alter the direction of light rays instead of a mirror where that prism is composed of appropriately colored material.

8.) Retain the color filter but include any of the other modifications made in alternative embodiments 1 through 7.

9.) Add any component functioning as a protective cover across the first surface of hologram where that component is composed of appropriately colored material.

10.) Add any component which functions as a color filter anywhere where that component is composed of appropriately colored material.

11.) Add a cover plate of substantially clear material (that is, not appropriately colored material) in place of the color filter and add a color filter anywhere including between the cover plate and the second surface of the hologram.

12.) Add a cover plate of substantially clear material in place of the color filter and add a color filter anywhere between the lamp and the first surface of the hologram such that light rays emitted by the lamp must pass through that color filter before striking the first surface of the hologram.

13.) Add a cover plate of substantially clear material and use a hologram which is itself of appropriately colored such that no other color filtering is required. Note that in this context the hologram may be referred to as a holographic plate or as developed holographic film depending on the technology involved.

14.) Eliminate the color filter and do not replace it with a cover plate, but employ a hologram which is embedded in or set in material of sufficient durability such that no cover plate is required and where the hologram itself is of appropriately colored material such that no other color filtering is required.

15.) Eliminate the mirrors and eliminate the light baffles and change the rotation of the lamp such that it can light the hologram directly and change the rotation of the hologram such that it is struck by light rays emitted by the lamp at its reference angle. Note that this arrangement assumes the holographic images will be viewed at an angle to the direction of the light rays emitted by the lamp.

16.) Eliminate the mirrors and eliminate the light baffles and change the position of the hologram although not its rotation and change the rotation of the lamp such that the hologram is struck by light rays emitted by the lamp at the reference angle of the hologram.

17.) Replace the two large mirrors with any number of smaller mirrors disposed in the same two planes as the mirrors they replace such that the light channel is unchanged.

18.) Replace the two large mirrors with any number of smaller mirrors and arrange those mirrors so that no two of them are necessarily coplaner and such that light rays emitted by the lamp are incident upon the first surface of the hologram at its reference angle.

19.) Replace one of the two large mirrors with two or more smaller mirrors and align those mirrors as in alternative embodiments 17 or 18.

20.) Realign the two large mirrors such that they are not substantially parallel.

21.) Replace the two large mirrors with any number of smaller mirrors such that no two of them are necessarily parallel.

22.) Replace one of the two large mirrors with any number of smaller mirrors such that no smaller mirror is necessarily parallel to the large mirror.

23.) Replace the two large mirrors with a single mirror such that light rays incident upon the first surface of the hologram strike that surface at the reference angle of the hologram.

24.) Replace the mirrors with reflective surfaces such as polished metal or foil which are the functional equivalent of mirrors.

25.) Replace the mirrors with prisms.

26.) Replace the mirrors with any optical device which changes the direction of light rays.

27.) Replace the lamp with two or more lamps.

28.) Replace the lamp with a light emitting diode or a number of light emitting diodes.

29.) Replace the lamp with an arrangement of light emitting diodes or miniature lamps in subtantially parallel alignment.

30.) Replace the lamp with an arrangement of light emitting diodes or miniature lamps in substantially parallel alignment and include a partitioning structure disposed across the light channel between the light emitting diodes or miniature lamps and the first surface of the hologram such that any light rays emitted by the light emitting diodes or miniature lamps not substantially parallel to the sides of the partitions which make up the partitioning structure strike those same partitions and only those light rays which are substantially parallel to the sides of those partitions strike the first surface of the hologram.

31.) Replace the lamp with an arrangement of light emitting diodes or miniature lamps in substantially parallel alignment and include any partitioning structure disposed across the light channel between the light emitting diodes or miniature lamps and the first surface of the hologram such that any light rays passing through that partitioning structure are substantially parallel.

32.) Employ the arrangement of light emitting diodes or miniature lamps and the partitioning structure of alternative embodiment number 30 except that the light emitting diodes or miniature lamps are not in substantially parallel alignment.

33.) Employ the arrangement of light emiting diodes or miniature lamps and any partitioning structure of alternative embodiment number 31 except that the light emitting diodes or miniature lamps are not in substantially parallel alignment.

34.) Replace the lamp with an arrangement of light emitting diodes or miniature lamps which are not in substantially parallel alignment.

35.) Use two or more holograms in place of the single hologram.

36.) Replace the hologram and use two or more holograms not necessarily coplaner.

37.) Replace the hologram and use two or more holograms not necessarily parallel.

38.) Use a hologram which does not have a single reference angle. Note that it is possible to produce holograms having several or a continously varying reference angle as the position on the surface of the hologram changes.

39.) Replace the hologram with a curved hologram.

40.) Use a hologram which is described as not having a reference angle, but an alternative term for the same thing such as lighting angle, illumination angle, or incidence angle.

41.) Use a hologram which is called a diffraction grating.

42.) Use a hologram which is an embossed surface.

43.) Use a hologram which is an embossed surface and is called anything other than a hologram.

44.) Use a hologram which is called a transmission hologram.

45.) Use a hologram which is called a reflection hologram.

46.) Use a reflection hologram and change the lighting arrangement such that the hologram is lighted on its second surface.

47.) Use any hologram which is embedded in, mounted in, or enclosed in some other material or structure.

48.) Use a hologram which is referred to by the photographic technology used to produce it or the photo chemical process used to produce it or the film stock used to produce it.

49.) Use a hologram which is a thermoplastic hologram.

50.) Use a hologram which is an embossed hologram.

51.) Use a hologram which is a dichromatic gelatin hologram.

52.) Combine alternative embodiments 15 or 16 in a circular or any other regular geometric pattern or in any irregular pattern.

53.) Combine the preferred embodiment in any regular geometric pattern or in any irregular pattern.

54.) Make any changes which can be described as making the indicated changes which characterize two or more of the listed or unlisted alternative embodiments.

In addition to the alternative embodiments listed there are others less obvious but which are anticipated by and contained in categories A, B, C, or D above. There are also alternative embodiments which involve exotic configurations of some or all of the elements of the preferred embodiment or the alternative embodiments. Accordingly, the scope and ramifications of the invention should be determined not only by the embodiments described but also by the claims.

I claim:

1.) A simulated weapon comprising:

(a) a hologram, (b) means to produce sound effects, (c) means to induce said hologram to project holographic images and to activate concurrently said means to produce sound effects, (d) structural means to house said hologram and said means to induce said hologram to project holographic images and to position said means to produce sound effects and to provide an appearance as a toy intended to resemble a weapons system, such that the holographic images are projected into a region of space including said hologram and including also the adjacent space generally fore and aft thereof and such that said means to induce said hologram to produce holographic images can be turned on and turned off by the user;

the images projected by said hologram resemble the rays or beams of space guns, ray guns, or laser weapons such as those displayed in motion pictures, television programs, video games or comic books in that the holographic images have three dimensions and appear to occupy space without being tangible.

2.) A simulated weapon according to claim 1 wherein said means to induce said hologram to project holographic images includes color filtering means such that any projected images are substantially monochromatic.

3.) A simulated weapon according to claim 1 wherein said means to induce said hologram to project holographic images uses a lighting arrangement comprising:

an interior chamber, an electric lamp, means to block light rays, and reflection means, where said electric lamp and said means to block light rays and said reflection means and said hologram are arranged in and adjacent to said interior chamber such that said means to block light rays prevent light rays emitted by said electric lamp from traveling in a straight line to said hologram and the preponderance of light rays emitted by said electric lamp striking said hologram do so after striking said reflection means.

4.) A simulated weapon according to claim 1 further including a plurality of electric lamps disposed about said structural means such that different groups of said electric lamps can be operated in conjunction with said means to produce sound effects and in a sequence which includes the operation of said means to induce said hologram to project holographic images.

5.) A simulated weapon according to claim 4 further including a plurality of platforms attached to the exterior of said structural means such that groups of said electric lamps can be mounted thereon.

6.) A simulated weapon according to claim 5 further including hinge means such that a plurality of said platforms can be positioned at various angles to the exterior of said structural means including being perpendicular to the exterior and being parallel to the exterior.

7.) A simulated weapon according to claim 1 wherein said means to induce said hologram to project holographic images and said means to produce sound effects are powered by electric storage battery means.

8.) A simulated weapon according to claim 1 wherein said structural means are capable of being mounted on toy treads such as are used on toy tanks and toy construction equipment.

9.) A simulated weapon resembling various other simulated weapons found in the prior art where lighting means or other means are employed to create the appearance of muzzle flashes or laser-type beams or rays or any other type of visual effect associated in the popular imagination with the operation of certain high-tech weapons, where those lighting means and other means include light sources appearing to be two dimensional or appearing to be a solid object having a light-emitting surface, solid objects having a light-emitting surface, and objects having a light-emitting surface in rapid motion, and where beams or rays associated in the popular imagination with the operation of fantasy weapons such as space guns or ray guns are not projected, but, unlike those simulated weapons described, comprising:

(a) diffraction means, (b) a device to produce sound effects, (c) a device using said diffraction means to produce holographic images and to actuate said device to produce sound effects in conjunction with the production of holographic images, (d) structural means to house said device using diffraction means and said diffraction means and to position said device to produce sound effects and to provide the appearance of a high-tech weapon such as might produce rays or beams, such that the holographic images produced occupy a region of space in front of the plane including the outer surface of said diffraction means, and such that said device using said diffraction means can be activated and deactivated by the user;

the images produced by said device using diffraction means resemble beams or rays associated in the popular imagination with the operation of fantasy weapons such as space guns or ray guns, especially as they have been portrayed in motion pictures, televison programs, video games, and comic books in that the images occupy three dimensions, and are not tangible.

10.) A simulated weapon according to claim 9 wherein the holographic images produced occupy a region of space including said diffraction means and including also adjacent space generally fore and aft thereof.

11.) A simulated weapon according to claim 10 wherein said device using said diffraction means to produce holographic images includes color filtering means such that any projected images are substantially monochromatic.

12.) A simulated weapon according to claim 10 wherein said device using said diffraction means to produce holographic images uses lighting means, and reflection means, such that light rays emitted by said lighting means are directed by said reflection means to be incident upon said diffraction means such that it produces holographic images.

13.) A simulated weapon according to claim 12 wherein said device using said diffraction means to produce holographic images uses light blocking means to prevent light rays from traveling directly from said lighting means to said diffraction means.

14.) A simulated weapon according to claim 10 further including a plurality of external lamps disposed about said structural means such that different groups of said external lamps can be operated in conjunction with sound effects and in a sequence which includes the operation of said device using said diffraction means to produce holographic images.

15.) A simulated weapon according to claim 14 further including a plurality of hinged platforms attached to the exterior of said structural means capable of being positioned at various angles to the exterior of said structural means including being perpendicular to the exterior and being parallel to the exterior such that groups of said external lamps can be mounted thereon.

16.) A simulated weapon comprising:

(a) holographic means, (b) a device to produce sound effects, (c) a device using said holographic means to project three dimensional images and to operate said device to produce sound effects in conjunction with projecting holographic images and having an appearance resembling a weapon and such that operation can be initiated and terminated by the user;

where the three dimensional images projected are visible in any portion of space including said holographic means and including also adjacent space fore and aft thereof and further including the space adjacent and circumferential to those volumes of space such that some portion of the images is forward of at least one plane tangent to the outer surface of said holographic means;

the three dimensional images projected resemble rays or beams of space guns or ray guns as they have been portrayed in motion pictures, television programs, video games, and comic books in that they are not tangible objects.

17.) A simulated weapon according to claim 16 wherein said device using said holographic means includes color filtering means such that any produced images are substantially monochromatic.

18.) A simulated weapon according to claim 16 wherein said device using said holographic means to project three dimensional images uses a lighting arrangement comprising:

an interior chamber, lighting means, light blocking means, and reflection means, where said lighting means and said light blocking means and said reflection means are arranged in and adjacent to said interior chamber such that said light blocking means prevent light rays emitted by said lighting means from striking said holographic means directly and the preponderance of those light rays emitted by said lighting means striking said holographic means do so after striking said reflection means.

19.) A simulated weapon according to claim 16 further including a plurality of external lamps disposed about said device using said holographic means to project three dimensional images such that different groups of said external lamps can be operated in conjunction with sound effects and in a sequence which includes the operation of said device using said holographic means to project three dimensional images.

20.) A simulated weapon according to claim 19 further including a plurality of platforms attached to the exterior of said device using said holographic means to project three dimentional images such that groups of said external lamps can be mounted thereon.

* * * * *

UNITED STATES PATENT AND TRADEMARK OFFICE

CERTIFICATE OF CORRECTION

PATENT NO. : 6,206,748 B1
DATED : March 27, 2001
INVENTOR(S) : Christopher Kauth It is certified that error appears in the above-identified patent and that said Letters Patent is hereby corrected as shown below:

Title page,
Delete "[76] Inventor: Christopher Kauth, 268 Bush St.
3005, San Francisco, CA (US) 94104
and replace it with: -- [75] Inventor: Christopher Kauth, San Francisco, Calif. --

Signed and Sealed this

Fourteenth Day of May, 2002

*Attest:*

*Attesting Officer*

JAMES E. ROGAN
*Director of the United States Patent and Trademark Office*